US011540682B2

(12) United States Patent
Hyun et al.

(10) Patent No.: US 11,540,682 B2
(45) Date of Patent: Jan. 3, 2023

(54) CLEANER

(71) Applicant: LG ELECTRONICS INC., Seoul (KR)

(72) Inventors: Kietak Hyun, Seoul (KR); Sangchul Lee, Seoul (KR); Jonguk Her, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/059,336

(22) PCT Filed: May 10, 2019

(86) PCT No.: PCT/KR2019/005638
§ 371 (c)(1),
(2) Date: Nov. 27, 2020

(87) PCT Pub. No.: WO2019/231131
PCT Pub. Date: Dec. 5, 2019

(65) Prior Publication Data

US 2021/0212529 A1 Jul. 15, 2021

(30) Foreign Application Priority Data

May 31, 2018 (KR) ..... 10-2018-0062594

(51) Int. Cl.
*A47L 5/24* (2006.01)
*A47L 9/12* (2006.01)
(Continued)

(52) U.S. Cl.
CPC ..... *A47L 5/24* (2013.01); *A47L 9/122* (2013.01); *A47L 9/1641* (2013.01);
(Continued)

(58) Field of Classification Search
CPC ..... A47L 9/122; A47L 9/1641; A47L 9/1666; A47L 9/2884; A47L 9/322; A47L 9/1616; A47L 9/10; A47L 5/00; A47L 5/24
(Continued)

(56) References Cited

U.S. PATENT DOCUMENTS 4,685,171 A * 8/1987 Beaudoin ..... A47L 9/02 15/332
8,151,407 B2 * 4/2012 Conrad ..... A47L 5/362 15/327.2
(Continued)

FOREIGN PATENT DOCUMENTS

CN 206576819 U 10/2017
EP 1 845 829 A2 10/2007
(Continued)

OTHER PUBLICATIONS

PCT International Search Report and Written Opinion, dated Aug. 14, 2019, issued in International Application No. PCT/KR2019/005638 (13 pages).
(Continued)

*Primary Examiner* — Brian D Keller
(74) *Attorney, Agent, or Firm* — Birch, Stewart, Kolasch & Birch, LLP

(57) ABSTRACT

The present disclosure includes a first housing configured in a cylindrical shape, an inlet port provided to the first housing to suck air therein, an inlet pipe communicating with the inlet port and extending to a front side of the housing with a length-directional axis positioned side by side with a ground surface, a cyclone forming part provided to separate dust from air flowing into the first housing, a second housing communicating with the first housing and coupled to a rear side of the first housing, a fan provided with the second housing to provide a suction force to enable air to be sucked into the first housing through the inlet port, a battery
(Continued)

provided to supply power to the fan, and a handle part including a handle base coupled to a top side of the first housing and a handle body connected to the handle base.

11 Claims, 10 Drawing Sheets

(51) Int. Cl.
*A47L 9/16* (2006.01)
*A47L 9/28* (2006.01)
*A47L 9/32* (2006.01)

(52) U.S. Cl.
CPC ..... *A47L 9/1666* (2013.01); *A47L 9/2884* (2013.01); *A47L 9/322* (2013.01)

(58) Field of Classification Search
USPC ..... 15/344, 335, 347, 327
See application file for complete search history.

(56) References Cited

U.S. PATENT DOCUMENTS

| | | | | |
|---|---|---|---|---|
| 2007/0144116 | A1* | 6/2007 | Hong | A47L 9/0081 55/345 |
| 2008/0134460 | A1* | 6/2008 | Conrad | A47L 9/0027 15/335 |
| 2008/0172995 | A1* | 7/2008 | Conrad | A47L 9/1625 55/345 |
| 2010/0212104 | A1* | 8/2010 | Conrad | A47L 9/1641 15/347 |
| 2014/0245566 | A1* | 9/2014 | Conrad | A47L 9/1666 15/353 |
| 2017/0027400 | A1* | 2/2017 | Lee | A47L 9/2842 |
| 2017/0332860 | A1* | 11/2017 | Nam | A47L 9/106 |
| 2017/0340179 | A1* | 11/2017 | Peflof | A47L 9/2884 |

FOREIGN PATENT DOCUMENTS

| | | | | |
|---|---|---|---|---|
| EP | 3 003 109 | | 4/2016 | |
| EP | 3282057 | A1 * | 2/2018 | A47L 5/14 |
| JP | 2002-017635 | A | 1/2002 | |
| JP | 5485715 | B2 | 5/2014 | |
| JP | 2015-173673 | A | 10/2015 | |
| KR | 10-0730955 | B1 | 6/2007 | |
| KR | 10-2017-0112911 | | 10/2017 | |
| WO | WO 2006/076363 | A2 | 7/2006 | |
| WO | WO 2017/147643 | A1 | 9/2017 | |

OTHER PUBLICATIONS

Korean Notice of Allowance dated Oct. 28, 2019 in Application No. 10-2018-0062594 (1 page).

* cited by examiner

CLEANER

TECHNICAL FIELD

The present disclosure generally relates to a cleaner, and more particularly, to a vacuum cleaner.

BACKGROUND

Generally, a cleaner is an appliance for discharging air from a body of the cleaner in a manner of sucking external air containing particles such as dust and the like using a negative pressure generated by a fan installed in the body, filtering off the particles, and then discharging the air from the body.

According to the power supply types, cleaners can be mainly categorized into a wired cleaner having power supplied from a power socket using a wire externally extended from a body and a wireless cleaner having a secondary battery installed in itself.

As the wireless cleaner market is fast growing, although the relevant technologies tend to be developed together, there are still many tasks including fatigue caused by cleaner weight, user's displeasure due to the discharged air, a problem of air suction efficiency and the like.

A related art cleaner is shown in FIG. 1. Problems of the related art are described with reference to FIG. 1 as follows.

First of all, in a related art cleaner, a fan is provided within a housing C and a handle A is disposed in rear of the fan. In doing the cleaning, fatigue on user's wrist, shoulder, arm, waist and the like may be aggravated disadvantageously.

Namely, as center of gravity of the fan that is one of the heavy components of the cleaner is relatively spaced apart from a center of the handle A, when the cleaner is moved in back-and-forth or top-and-down directions or a high spot such as a ceiling is cleaned, a relatively more force is required.

Secondly, as a related art cleaner is generally configured to discharge air into a space in front of a user, hot air stays on a user's moving route, thereby causing a problem of displeasure to a user.

Thirdly, regarding a related art cleaner, since an air inlet of a fan housing is located above and an air outlet is located below, a flow path resistance generated from an inside of the housing C due to unnecessary flow path bending is disadvantageously high.

SUMMARY

Technical Problem

Accordingly, embodiments of the present disclosure are directed to a cleaner that substantially obviates one or more problems due to limitations and disadvantages of the related art.

One object of the present disclosure is to provide a cleaner capable of alleviating user's fatigue by lowering the torque required for moving the cleaner.

Another object of the present disclosure is to provide a cleaner capable of not discharging air into a space in front of a user.

Further object of the present disclosure is to provide a cleaner having high suction efficiency or strong suction power attributed to a fan by reducing the flow path resistance.

Technical tasks obtainable from the present disclosure are non-limited by the above-mentioned technical tasks. And, other unmentioned technical tasks can be clearly understood from the following description by those having ordinary skill in the technical field to which the present disclosure pertains.

Technical Solution

Additional advantages, objects, and features of the disclosure will be set forth in the disclosure herein as well as the accompanying drawings. Such aspects may also be appreciated by those skilled in the art based on the disclosure herein.

To achieve these objects and other advantages and in accordance with the purpose of the disclosure, as embodied and broadly described herein, a cleaner according to one embodiment of the present disclosure may include a first housing configured in a hollow cylindrical shape, an inlet port provided to a circumferential surface of the first housing for air suction, an inlet pipe communicating with the inlet port and extending to a front side of the housing with a length-directional axis positioned side by side with a ground surface, a cyclone forming part provided within the first housing to separate dust from air flowing into the first housing, a second housing communicating with the first housing and coupled to a rear side of the first housing, a fan provided within the second housing to provide a suction force to enable air to be sucked into the first housing through the inlet port, a battery provided within the second housing to supply power to the fan, and a handle part including a handle base coupled to a top side of the first housing and a handle body connected to the handle base.

In the exemplary embodiments, the handle may further include a connecting portion extending upward from the handle base to connect the handle base and the handle body together and the handle body may extend from a top end of the connecting portion to a rear side of the connecting portion so that a length-directional axis is positioned side by side with a top surface of the second housing.

In the exemplary embodiments, the length-directional axis of the handle body may be located in a plane vertical to the ground surface by passing through a length-directional center of the inlet pipe.

In the exemplary embodiments, both lateral sides of the second housing may be provided to right and left tangential surfaces of the first housing side by side with the length-directional axis of the inlet pipe, respectively.

In the exemplary embodiments, the cleaner may further include a battery receiving portion provided within the second housing to receive the battery therein, the battery receiving portion may be provided to incline to a left or right side within the second housing, and the fan may be provided to incline in a direction opposite to an inclining direction of the battery receiving portion within the second housing.

In the exemplary embodiments, the cleaner may further include a second housing cover provided to one lateral side of the second housing in the inclining direction of the fan, the second housing having a multitude of air discharge holes.

In the exemplary embodiments, the cleaner may further include a housing communicating hole formed in a circumferential surface of the first housing to enable the first housing and the second housing to communicate with each other.

In the exemplary embodiments, the fan may include a motor including a stator, a rotor rotated by the stator, and an impeller rotation shaft provided vertical to the ground surface by having the rotor joined thereto, an impeller connected to the impeller rotation shaft to make air flow, and a fan housing fixed to the second housing and receiving the impeller and the motor therein, a fan housing air inflow port for enabling air to flow into the fan housing may be formed in a top surface of the fan housing, and the housing communicating hole may be provided to a position higher than that of the fan housing air inflow port.

In the exemplary embodiments, one portion of a bottom surface of the handle base may be coupled to a top surface of the first housing and the other portion may be coupled to a top surface of the second housing.

In the exemplary embodiments, the cleaner may further include a battery receiving portion provided within the second housing to receive the battery therein, and a battery insertion port communicating with the battery receiving portion may be formed in a rear side surface of the second housing.

In the exemplary embodiments, the battery receiving portion may have a height-directional length greater than a right-left width-directional length.

In the exemplary embodiments, the battery receiving portion may have a height-directional length greater than a front-rear-directional length.

Further scope of applicability of the present disclosure will become apparent from the detailed description given hereinafter. However, it should be understood that the detailed description and specific examples, while indicating preferred embodiments of the disclosure, are given by illustration only, since various changes and modifications within the spirit and scope of the disclosure will become apparent to those skilled in the art from this detailed description.

Advantageous Effects

Accordingly, a cleaner according to the present disclosure provides the following effects and/or features.

First of all, the present disclosure lowers the torque required for moving the cleaner, thereby reducing user's fatigue.

Secondly, the present disclosure prevents air from being discharged into a space in front of a user.

Thirdly, the present disclosure reduces the fluid path resistance, thereby having high suction efficiency or strong suction power attributed to a fan.

Effects obtainable from the present disclosure may be non-limited by the above mentioned effect. And, other unmentioned effects can be clearly understood from the following description by those having ordinary skill in the technical field to which the present disclosure pertains.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure.

DETAILED DESCRIPTION

Figure 1:
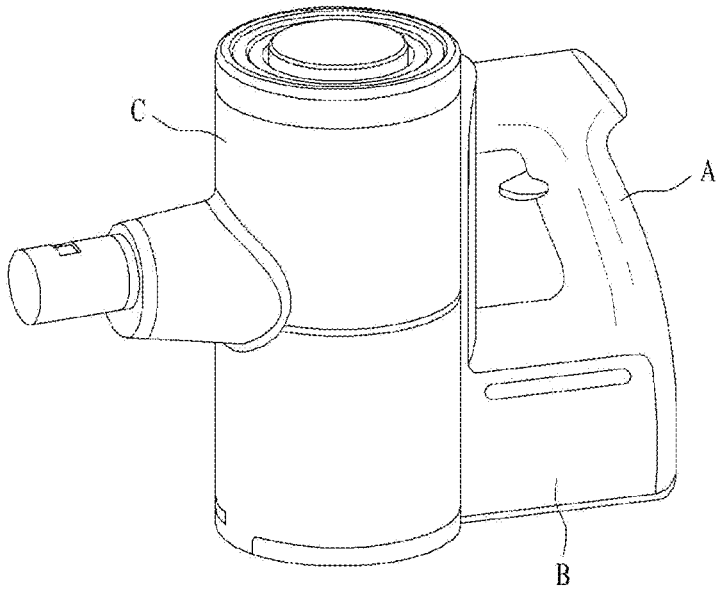
FIG. 1 is a schematically perspective diagram of an exterior of a cleaner of a related art.

Description will now be given in detail according to exemplary embodiments disclosed herein, with reference to the accompanying drawings. Yet, the embodiments and drawings are used to help the understanding of the present disclosure.

Moreover, to help the understanding of the present disclosure, s the accompanying drawings may be illustrated in a manner of exaggerating sizes of some components instead of using a real scale.

Thus, the present disclosure is non-limited to the following embodiment, and it is intended that the present disclosure covers the modifications and variations of this disclosure provided they come within the scope of the appended claims and their equivalents.

First of all, an overall structure of a cleaner 1 according to a preferred embodiment of the present disclosure is described with reference to FIG. 2.

The cleaner 1 according to one embodiment of the present disclosure may include a first housing 10 in a hollow cylindrical shape and an inlet part 30 provided to a circumferential surface of the first housing 10.

The first housing 10 may be provided in a manner that a length-directional axis A1 of a cylinder is vertical to a ground surface, and the inlet part 30 may include an inlet pipe 31. The inlet pipe 31 may be configured to communicate with an inlet port 12 (shown in FIG. 4) of the first housing 10 provided to the circumferential surface of the first housing 10. And, a length-directional axis of the inlet pipe 31 may be configured side by side with the ground surface in a manner of crossing with the length-directional axis A1 of the cylinder.

To help the understanding of the details of the cleaner structure described in the following, directions can be defined in a manner that an extending direction of the inlet pipe 31 of the inlet part 30 is defined as a front side with reference to the first housing 10. And, the complete opposite direction of the extending direction of the inlet pipe 31 may be defined as a rear side. Moreover, right and left side directions can be naturally defined depending on the above-defined front and rear side directions.

The cleaner 1 according to one embodiment of the present disclosure may further include a second housing 16 coupled to a rear surface of the first housing 10 to communicate with the first housing, a fan 60 provided within the second housing 16 to provide suction power, and a battery part 80 supplying power to the fan 60.

Particularly, the second housing 16 is configured in a hollow box shape so as to enclose the rear surface of the first housing 10.

Yet, if the second housing 16 can receive the fan 60 therein, it can have any shapes as well as the box shape.

A housing communicating hole 13 may be formed in the circumferential surface of the first housing 10, and more particularly, in a portion to which the second housing 16 is coupled. And, the housing communicating hole 13 may become a passage through which air in the first housing 10 flows into the second housing 16 by the fan 60.

The battery part 80 may include a battery 83 supplying power to the fan 60 and a battery receiving portion 81 provided within the second housing 16 to receive the battery 83 therein.

The battery receiving portion 81 may be provided in a manner that a height-directional length is greater than a right-left width direction. The battery receiving portion 81 may be provided in a manner that a height-directional length is greater than a front-rear directional length.

The cleaner 1 according to one embodiment of the present disclosure may further include a handle part 70.

The handle part 70 may include a handle base 71 coupled to a top surface of the first housing 10 and a handle body 73 connected to the handle base 71.

Particularly, the handle part 70 may further include a connecting portion 72 extending upward from the handle base 71 and the connecting portion 72 may connect the handle base 71 and the handle body 73 together. The handle body 73 may extend in a direction opposite to an extending direction of the inlet pipe 31 from a rear end of the connecting portion 72 so that a length-directional axis (denoted by A3 in FIG. 8) of the handle body 73 can be positioned side by side with the ground surface.

In this case, since the first housing 10 and the second housing 16 are located below the handle body 73, the torque applied to the handle body 73 becomes smaller, whereby a user can move the cleaner 1 with less strength.

For the rigid coupling of the handle part 70, one portion of a bottom surface of the handle base 71 may be coupled to a top surface of the first housing 10 and the rest of the bottom surface may be coupled to a top surface of the second housing 16.

Besides, a manipulating part 150 for ON/OFF of the cleaner 1 may be provided to a top surface of the handle body 73.

Hence, if a user grips the handle body 73, the user can naturally manipulate the manipulating part 150 with a thumb.

Configurations of the cleaner 1 disposed inside/outside the first housing 10 and the second housing 16 are described in detail with reference to FIGS. 3 to 5 as follows.

Figure 2:
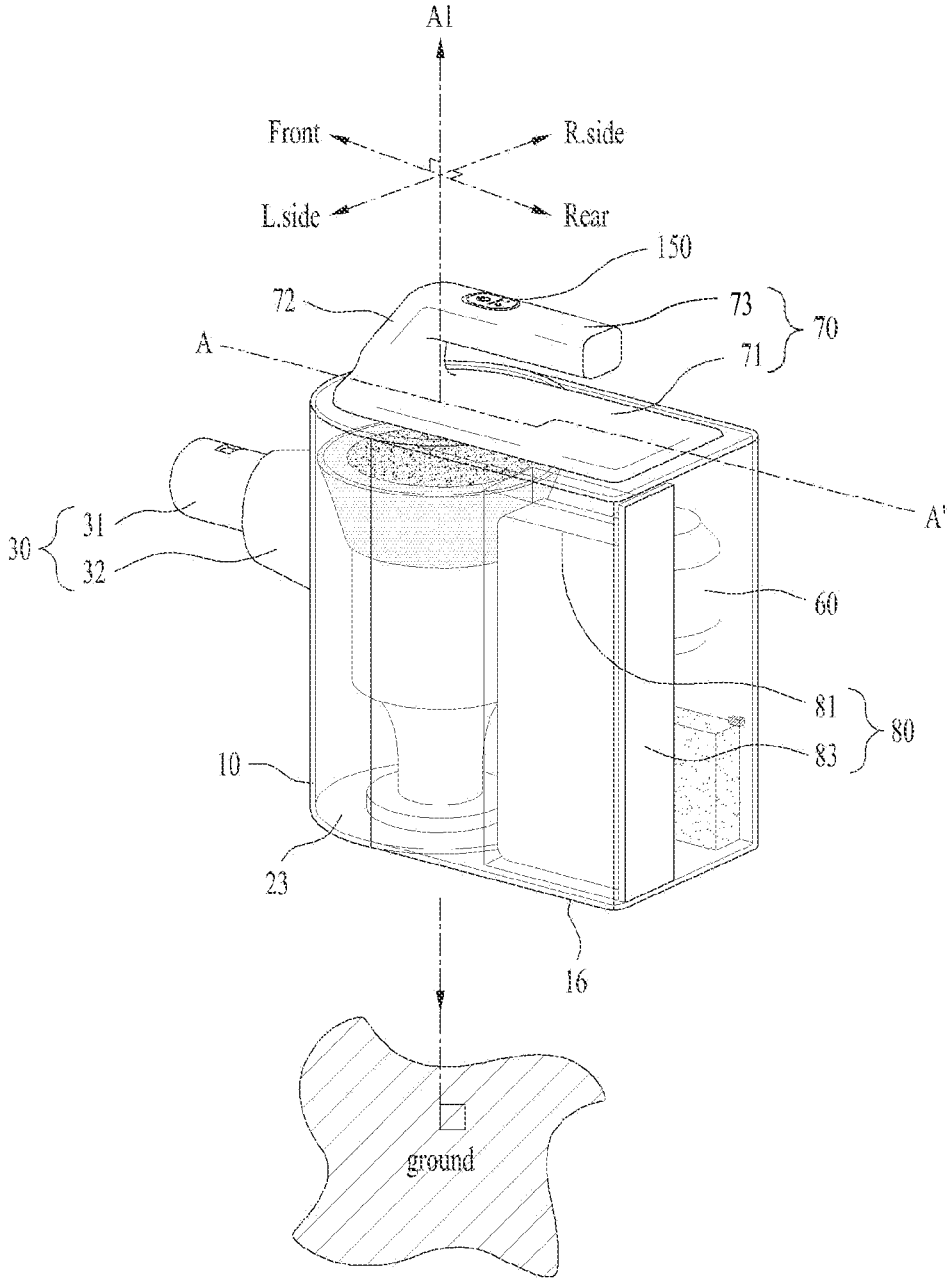
FIG. 2 is a perspective diagram of a cleaner according to one embodiment of the present disclosure.
Figure 3:
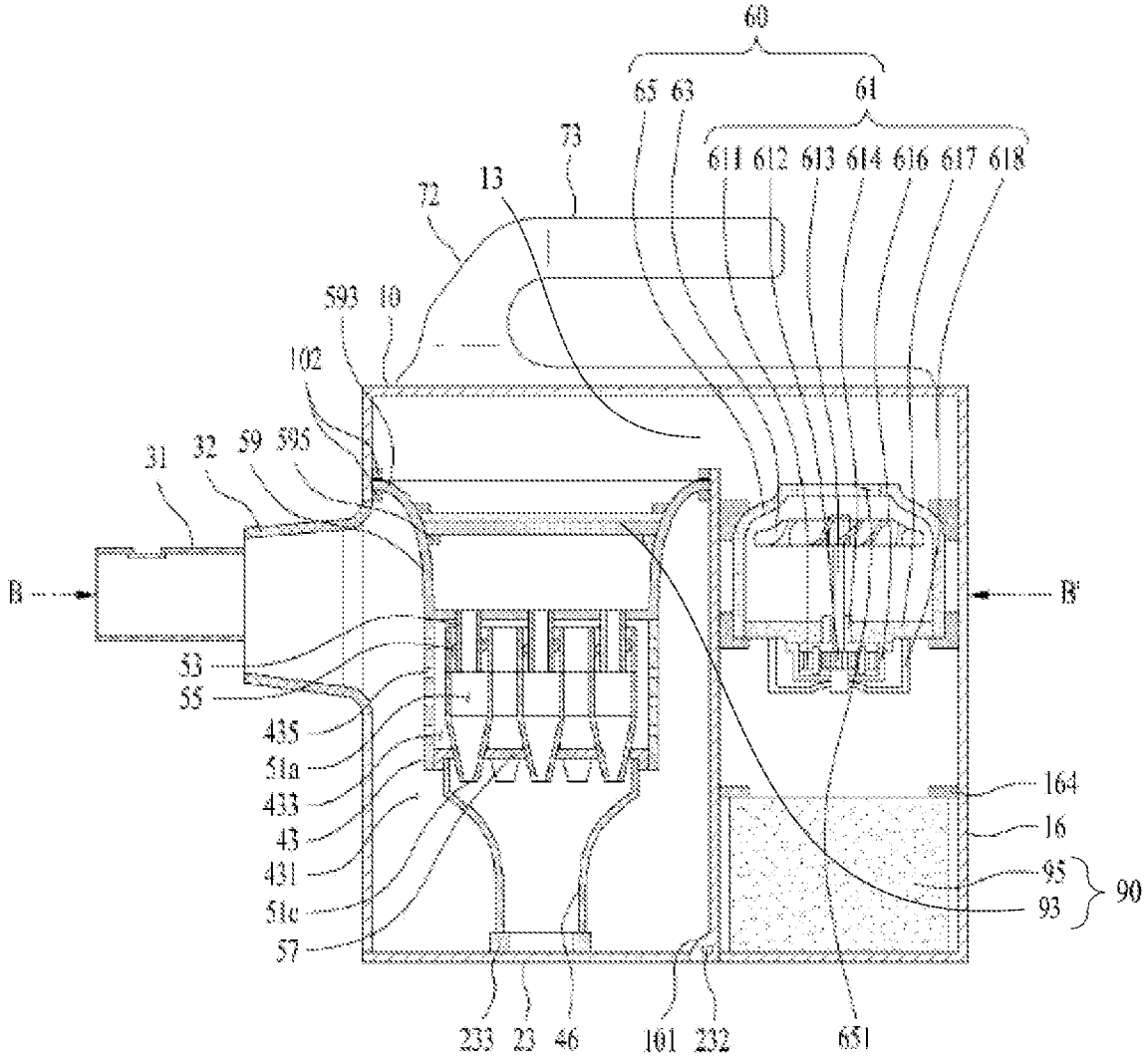
FIG. 3 is a cross-sectional diagram along A-A' shown in FIG. 2.

First of all, referring to FIG. 3 showing the A-A' cross-section shown in FIG. 2, the cleaner 1 according to one embodiment of the present disclosure may further include a first housing cover 23 coupled to a bottom side of the first housing 10 to form a bottom surface of the first housing 10.

The first housing cover 23 may be configured in a disc shape and hinge-joined to the first housing 10 so as to open/close a bottom opening side of the first housing 10 selectively.

Thus, if dust is accumulated within the first housing 10, a user opens the first housing cover 23 so as to discharge the dust from the first housing 10.

In order to hinge-join the first housing cover 23 to the first housing 10, a hinge-joining portion 232 is provided to a bottom side of the first housing 10 and a bottom cover connection hinge 101 joined to the hinge joining portion 232 may be provided to an edge of the first housing cover 23.

The cleaner 1 according to one embodiment of the present disclosure may further include a second housing cover 26 (cf. FIG. 9) coupled to a lateral side if the second housing 16, which shall be described in detail later.

In some implementations, the cleaner 1 according to one embodiment of the present disclosure separates dust from the sucked air using a cyclone effect, and the relevant configuration is described as follows.

First of all, a chamber case 43 in a cylinder shape smaller than the first housing 10 may be provided within the first housing 10. By the chamber case 43, an inner space of the first housing 10 may be divided into a first chamber 431 outside the chamber case 43 and a second chamber 433 inside the chamber case 43.

A multitude of chamber case perforated holes 435 may be formed in a circumferential surface of the chamber case 43. And, the chamber case perforated holes 435 may configure a path through which air within the first chamber 431 is filtered and flows into the second chamber 433.

A primary cyclone effect occurs in the first chamber 431, and a secondary cyclone effect may occur in the second chamber 433.

Figure 4:
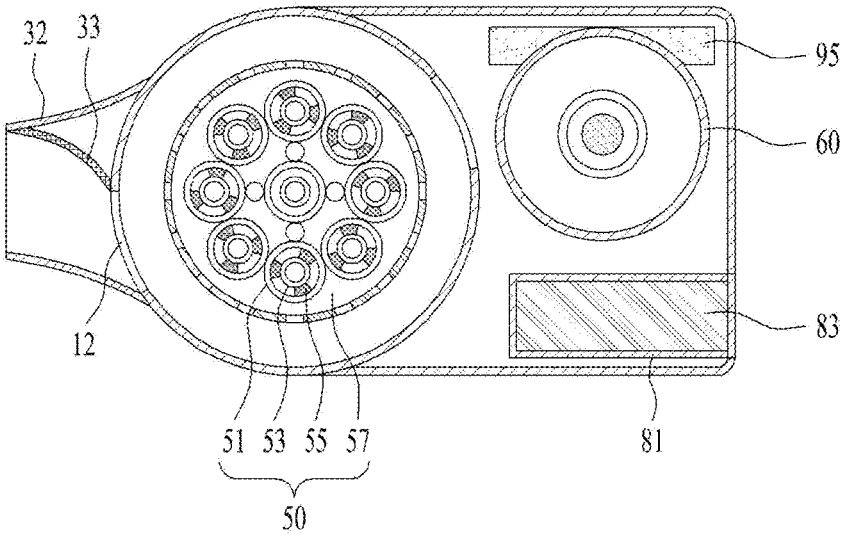
FIG. 4 is a cross-sectional diagram along B-B' shown in FIG. 3.

With reference to FIG. 3 and FIG. 4 showing the B-B' cross-section of FIG. 3, the configuration related to the primary cyclone effect occurring in the first chamber 431 is described as follows.

First of all, a center of the inlet port 12 is located in a manner of inclining to a right or left side in a prescribed range with reference to a length-directional axis of the inlet pipe 31, whereby the air flowing into the first chamber 431 can naturally rotate along an outer circumferential surface of the chamber case 43.

The inlet part 30 may further include an inlet pipe connecting portion 32 connecting the inlet pipe 31 to the first housing 10, and a rotation guider 33 guiding air to the inlet port 12 can be installed within the inlet pipe connecting portion 32.

The rotation guider 33 may be provided to connect one side most adjacent to the inlet pipe length-directional axis in the part forming the inlet port 12 on the outer circumferential surface of the first housing 10 to an opposite inner wall in the inlet port 12 inclining direction in the inner wall of the inlet pipe connecting portion 32.

Hence, the primary cyclone effect that air rotates along the outer circumferential surface of the chamber case 43 occurs within the first chamber 431. As the air is rotated, dusts relatively heavier than the air fall down to the bottom of the first chamber 431.

Thereafter, the air is filtered through the chamber case perforated hole 435 and then flow into the second chamber 433.

Configuration related to the secondary cyclone effect occurring in the second chamber 433 is described as follows.

Figure 5:
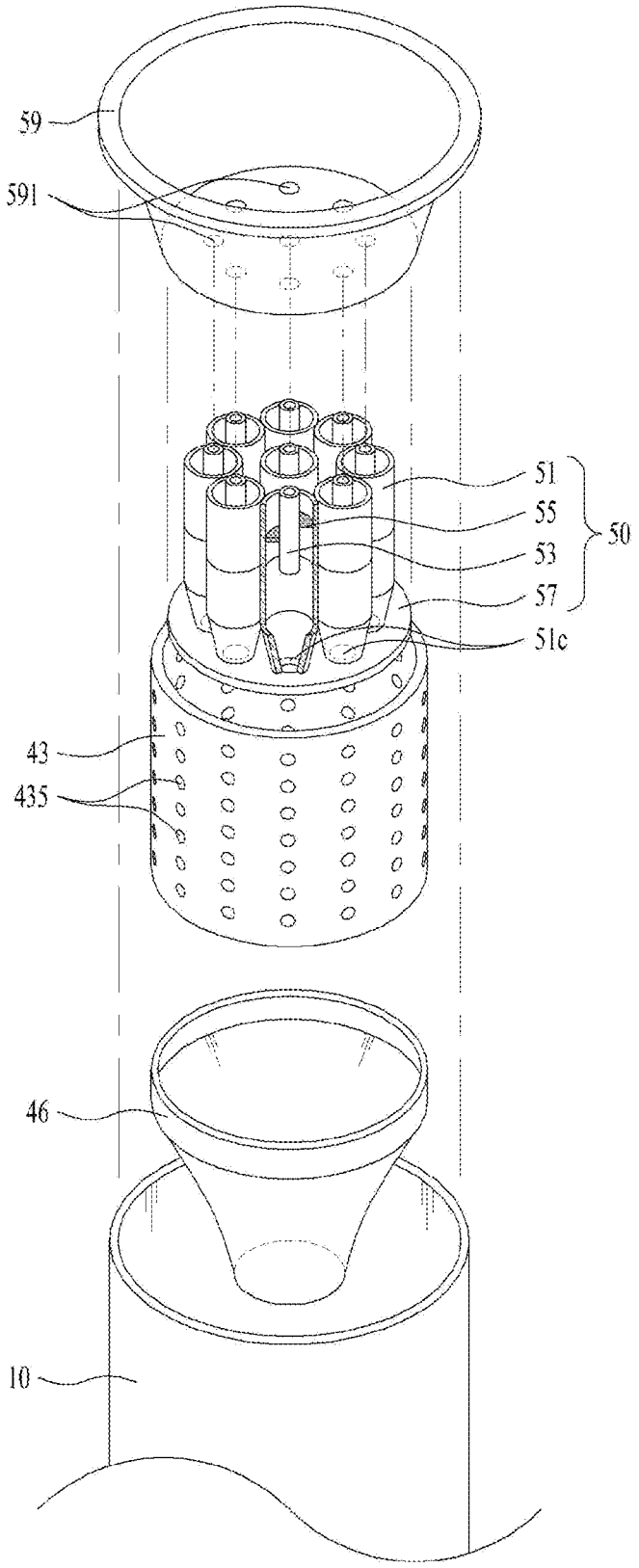
FIG. 5 is an exploded perspective diagram of a chamber case and a cyclone forming part of a cleaner according to one embodiment of the present disclosure.

Although the following description is made with reference to FIG. 3, details of the coupling can be further clearly understood by referring to FIG. 5 that is an exploded perspective diagram.

The cleaner 1 according to one embodiment of the present disclosure may further include a cyclone forming part 50 provided to the second chamber 433.

Moreover, the cyclone forming part 50 may include a multitude of flow path bodies 51, each of which is configured in a cylindrical shape having open top and bottom sides with a length-directional axis vertical to the first housing cover 23 or the ground surface and has a lower portion configured in a conic shape having a diameter continuously decreasing downward.

Each of a multitude of the flow path bodies 51 forms a dust separating flow path 51*a* in which air flows by rotating centering on the axis vertical to the first housing cover 23 or the ground surface. And, an ascending pipe 53, in which an ascending air current is formed by the fan 60, may be provided within each of a multitude of the flow path bodies 51.

The ascending pipe 53 may be configured in a cylindrical shape of which top and bottom sides are open. And, an inflow port 51*b* (or an open top side) for air to flow in the dust separating flow path 51*a* may be formed between a top surface of the flow path body 51 and the ascending pipe 53.

Moreover, a vane 55 may be provided between the ascending pipe 53 and the flow path body 51 to connect an outer circumference and an inner circumference of the flow path body 51 together.

The vane 55 is configured to incline at a prescribed angle with reference to a plane side by side with the ground surface and plays a role in rotating the air flowing in the inflow port 51*b*.

Besides, a dust discharge port 51*c* formed as an open plane may be formed at the bottom side of each of a multitude of the flow path bodies 51.

According to the above-described configuration, in the cyclone forming part 50, the secondary cyclone effect occurs in a manner that the air flows in the inflow port 51*b* and then descends by being rotated by the vane 55 along the dust separating flow path 51*a*. Thereafter, the air ascends along the ascending pipe 53.

In doing so, dusts contained in the air fail to flow in the ascending pipe 53 due weights of their own but are externally discharged from the flow path body 51 through the dust discharge port 51*c*.

A multitude of the flow path bodies 51 can be connected to each other through a connecting plate 57. And, the connecting plate 57 may be configured in a disc shape corresponding to an inner circumference shape of the chamber case 43.

A dust separating part 46 in a conic shape having open top and bottom sides may be provided to a bottom side of the connecting plate 57. And, the dust separating part 46 plays a role in storing the dust separated by the cyclone forming part 50.

Moreover, the dust separating part 46 also plays a role in preventing the air in the first chamber 431 from being sucked into the dust discharge port 51*c*. To this end, a top side of the dust separating part 46 is covered with the connecting plate 57 and a bottom side of the dust separating part 46 can be sealed by the first housing cover 23 and a ring-type packing rib 233 provided to the top side of the first housing cover 23.

Here, in order to secure the airtightness of the bottom side of the dust separating part 46, the packing rib 233 is preferably formed of flexible material.

In some implementations, the cleaner 1 according to one embodiment of the present disclosure may further include a partition 59 covering the top side of the second chamber 433, and the understanding of the relevant configuration can be further facilitated with reference to FIG. 3 and FIG. 4.

The partition 59 is provided above the chamber case 43, and a bottom side of the partition 59 may be configured in a cup shape capable of covering the top side of the second chamber 433.

A multitude of ascending pipe insertion holes 591 may be formed in the bottom side of the partition 59 so as to be coupled with the protruding portions of the ascending pipes 53, respectively.

The ascending pipe 53 is provided in a manner of protruding upward by a predetermined length from the top side of the flow path body 51 for the air inflow into the dust separating fluid path 51*a*, and a prescribed portion of the protruding portion may be joined to the portion forming the ascending pipe insertion hole 591 in the bottom surface of the partition 59.

A partition flange 593 extending by a predetermined length in a circumferential direction may be formed on a top rim of the partition 59. The partition flange 593 is coupled to a partition support rib 102 inside the first housing 10, thereby fixing the partition 59 to the first housing 10.

The air ascending in the ascending pipe 53 by the fan 60 may pass through a first filter 93 of a filter part 90 and then flow into the second housing 16 through the housing communicating hole 13. Details of the filter part 90 shall be described later for the easy understanding of the structure.

The fan 60 may mainly include a fan housing 65 forming an exterior of the fan 60 and enabling the fan 60 to be installed in the second housing 16, an impeller 63 provided within the fan housing 65 to make air flow, and a motor 61 provided within the fan housing 65 to provide rotation power to the impeller 63.

And, a diffuser (not shown) for evenly distributing an air flow formed by the impeller 63 may be provided between the impeller 63 and the motor 61.

First of all, the motor 61 may include a stator 611, a rotor 612 rotating by electromagnetic reaction with the stator 611*m* and an impeller rotation shaft 613 connecting the rotor 612 and the impeller 63 together and have a length-directional axis vertical to the ground surface or a bottom surface of the second housing 16.

The impeller rotation shaft 613 may be supported by a rotation shaft support portion 617 connected to the fan housing 65, and a bearing 614 enabling the rotation of the impeller rotation shaft 613 may be provided between the impeller rotation shaft 613 and the rotation shaft support portion 617.

And, a stator mount portion 616 fixing the stator 611 and a motor guard 618 protecting the motor 61 may be coupled to the rotation shaft support portion 617.

Hence, if power is supplied to the motor 61, the impeller 63 can be rotated by the motor 61 so that air can flow from an upper part of the second housing 16 to the lower part of the second housing 16.

The housing communicating hole 13 is located above the partition 59. In this case, air can flow into the second housing 16 without passing through the complicatedly bent flow path.

Therefore, according to the aforementioned embodiment of the present disclosure, as flow path resistance possibly generated from the complicatedly bent flow path of the peripheral part of the motor 61 is reduced, suction power or efficiency of the cleaner 1 can be increased excellently.

Besides, as a fan housing air inflow port 651 of the fan housing 65 is formed in the top plane of the fan housing 65, the air having flown into the housing communicating hole 13 can be naturally discharged through the air discharge hole 261 of the second housing cover 26 via the fan housing 65.

In this case, as a diameter of the fan housing air inflow port 651 is formed smaller than a length-directional center diameter of the fan housing, the suction power of the fan 60 can be maximized.

Moreover, a fan housing support rib 165 protruding toward the center of the second housing 16 may be provided to an inner circumferential surface of the second housing 16, thereby fixing the fan housing 65 to the second housing 16.

The filter part 90 shortly mentioned in the foregoing description is described in detail as follows. The filter part 90 may include a first filter 93 fixed to the partition 59 and a second filter 95 disposed in a space between the fan housing 65 and the second housing cover 26.

The filter 93 may be fixed to an inner circumferential surface of the partition 59 by a first filter support rib 595 of the partition 59, and the air having passed through the first filter 93 flows into the second housing 16 through the housing communicating hole 13.

The second filter 95 may be fixed to an inside of the second housing 16 by a second filter support rib 164 of the second housing 16 and the second housing cover 26.

Particularly, the second filter 95 may be located under the fan housing 65 and disposed to incline toward the second housing cover 26 with reference to a right-left width directional center of the second housing 16.

The second filter 95 is configured in a rectangular parallelepiped shape, and a face of the second filter 95 confronting the second housing cover 26 may have a size corresponding to that of the second housing cover 26. Of course, the confronting face may be larger than the size of the second housing cover 26.

According to the aforementioned flow path configuration, at least one portion of the second filter 95 is disposed to confront the fan housing air discharge port 653, thereby maximizing the filter effect.

A size of a hole formed by mesh of the first filter 93 is configured greater than that of a hole formed by mesh of the second filter 95, whereby dusts can be filtered off in order of large dust to small dust.

In order to raise the quality of the discharged air, the second filter 95 may be provided as HEPA filter. Since the HEPA filter is well known to those skilled in the art, its details shall be omitted from the following description.

Figure 6:
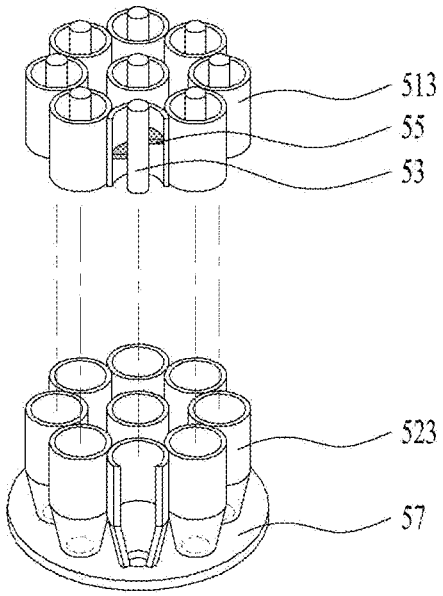
FIG. 6 is a perspective diagram of a cyclone forming part according to another embodiment of the present disclosure.

Another embodiment of the flow path body is described with reference to FIG. 6 as follows.

First of all, the flow path body 51 may be divided into a first pipe 513 in a cylindrical shape having open top and bottom sides and a second pipe 523 having an open top side and a dust discharge port 51*c* of a bottom side.

The ascending pipe 53 and the vane 55 may be provided to the first pipe 513.

The flow path body 51 may be integrated lie the former embodiment. To facilitate the manufacturing by injection molding, it is preferable that the first pipe 513 and the second pipe 523 are manufactured separately.

Figure 7:
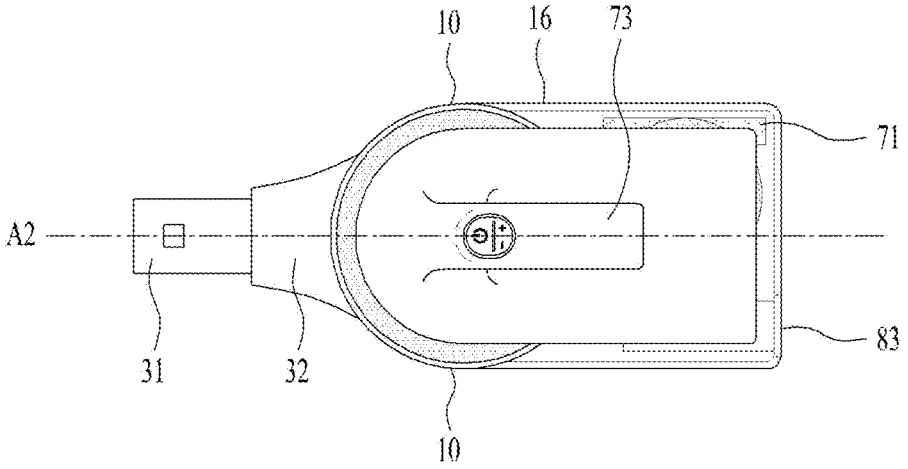
FIG. 7 is a diagram showing a top view of cleaner according to one embodiment of the present disclosure.
Figure 8:
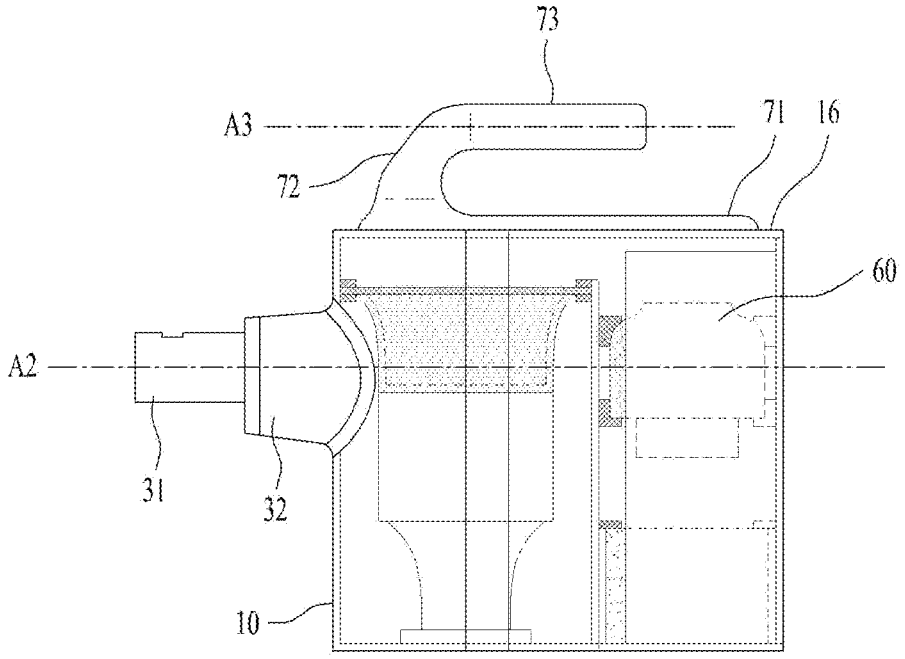
FIG. 8 is a lateral view diagram of a cleaner according to one embodiment of the present disclosure.

With reference to FIG. 7 and FIG. 8, the disposition relationship and weight center of the handle part 70, the first housing 10 and the second housing 16 shall be described in detail as follows.

First of all, both lateral sides of the second housing 16 may be provided to right and left tangential surfaces of the first housing 10 side by side with a length-directional axis A2 of the inlet pipe 31, respectively.

Moreover, a length-directional axis A3 of the handle body 73 may be located in a plane vertical to the ground surface by passing through the length-directional axis A2 of the inlet pipe.

As described above, since the heavy fan 60 and the heavy battery 83 are provided within the second housing 16, it is necessary to make the center of gravity positioned near the handle part 70 by appropriately disposing the fan 60 and the battery 83.

To this end, the battery receiving portion 81 may be configured to incline to the right or left within the second housing 16 and the fan 60 may be configured to incline in a direction opposite to the inclining direction of the battery receiving portion 81 within the second housing 16.

The fan 60 may be located at a position higher than a bottom end of the battery receiving portion 81 and lower than a top end thereof.

Hence, in comparison with the case that the battery receiving portion 81 and the fan 60 are disposed at different heights, respectively, the overall center of gravity of the fan 60 and handle body 73 can be formed closer to the handle body 73.

Thus, when a user moves while carrying the cleaner 1, torque applied to a hand is alleviated more remarkably than the related arts.

Moreover, a height-directional length of the second housing 16 may be provided to be equal to a height-directional length of the first housing, whereby the cleaner 1 can be stably seated on the ground surface.

Figure 9:
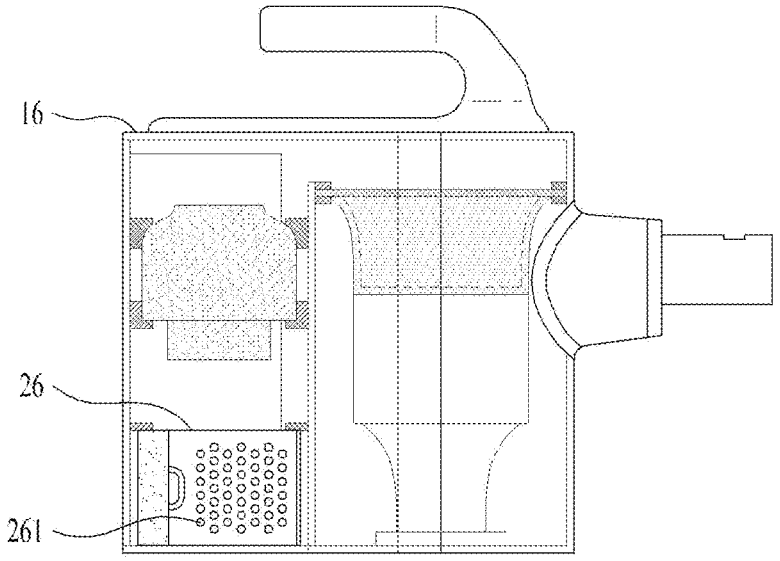
FIG. 9 is a diagram showing a lateral side opposite to the side shown in FIG. 8.

The second housing cover 26 is described in detail with reference to FIG. 9 as follows.

First of all, the second housing cover 26 is configured to form a prescribed portion of a lateral side of the second housing 16 and may be hinge-joined to the second housing 16 to open/close the prescribed portion of the lateral side of the second housing 16.

A multitude of air discharge holes 261 perforating the second housing cover 26 are formed in the second housing cover 26. And, air in the second housing 16 can be discharged externally through a multitude of the air discharge holes 261.

The second housing cover 26 may be located at a position lower than that of the fan 60 for the smooth air flow within the second housing 16.

And, the second housing cover 26 may be provided to the lateral side of the second housing 16 in the inclining direction of the fan 60.

Hence, when a user uses the cleaner by gripping the handle body 73, as hot air is discharged in a lateral direction of the user, user's displeasure can be reduced.

Figure 10:
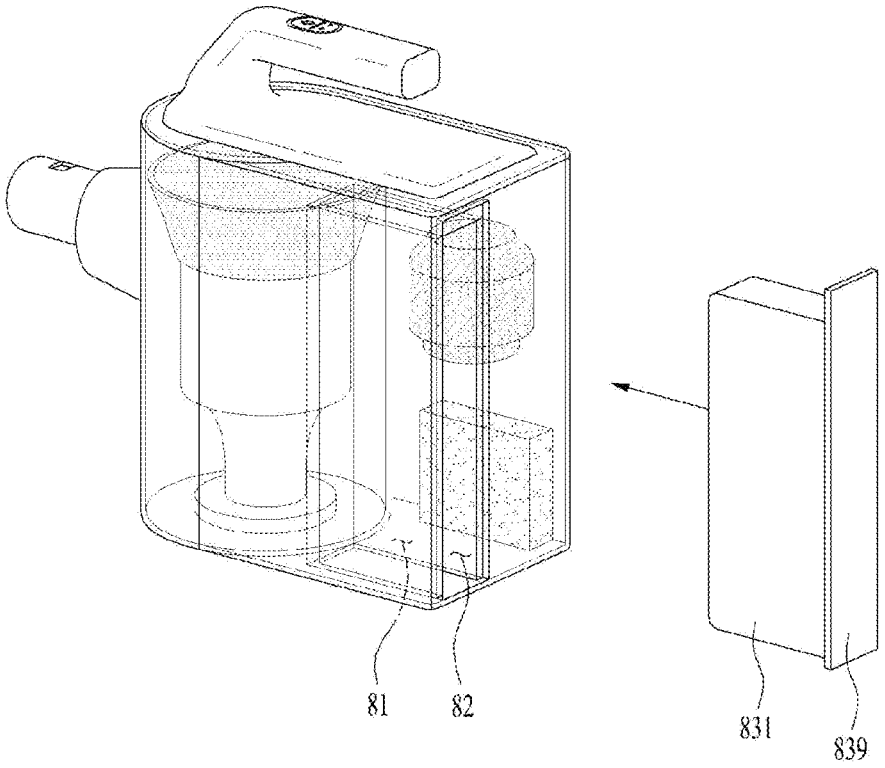
FIG. 10 is a perspective diagram of a battery part of a cleaner according to one embodiment of the present disclosure.

An embodiment of an insertion structure of the battery 83 is described with reference to FIG. 10 as follows.

First of all, the battery 83 may be provided to be detachably inserted in the battery receiving portion 81.

To this end, a battery insertion port 82 may be formed as an open plane on a rear side of the second housing 16.

Thus, the battery 83 can be received in the battery receiving portion 81 in a manner of sliding from a rear side to a front side through the battery insertion port 82.

The battery 83 may include a battery frame 831 forming an exterior and a terminal (not shown) transferring power to the motor 61.

A cover portion 839 extending in at least one of top and bottom directions may be provided to a rear side of the battery frame 831 to cover the battery insertion port 863.

Although the battery receiving portion 81 may be formed at a predetermined height, the battery 83 may be configured in various sizes for large and small storage batteries if necessary.

In case of using a small storage battery, a prescribed portion of the battery insertion port 82 keeps staying in an open state.

Therefore, according to the present embodiment, as the cover portion 839 covers the open portion of the battery insertion port 82, the dust inflow into the battery receiving portion 81 can be prevented and the beauty of the exterior view can be enhanced.

Effects not disclosed in this specification may be additionally provided by the aforementioned respective configurations of the present disclosure. And, it is a matter of course that new effects other than the related art can be provided according to the organic combinations of the aforementioned respective configurations.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

The invention claimed is:

1. A cleaner, comprising:

a first housing configured in a cylindrical shape;

an inlet port provided to the first housing for air suction;

an inlet pipe communicating with the inlet port and extending to a front side of the first housing with a length-directional axis parallel to a ground surface;

a cyclone forming part provided within the first housing to separate dust from air flowing into the first housing;

a second housing communicating with the first housing and coupled to a rear side of the first housing, first and second lateral sides of the second housing being provided to right and left tangential surfaces of the first housing side by side with the length-directional axis of the inlet pipe, respectively;

a fan provided within the second housing to provide a suction force to enable air to be sucked into the first housing through the inlet port;

a battery provided within the second housing to supply power to the fan;

a handle part including a handle base coupled to a top side of the first housing and a handle body connected to the handle base; and a battery receiving portion provided within the second housing to receive the battery therein, wherein the fan, the battery, and the battery receiving portion are located between the first and second lateral sides of the second housing.

2. The cleaner of claim 1, wherein the handle further comprises a connecting portion extending upward from the handle base to connect the handle base and the handle body together and wherein the handle body extends from a top end of the connecting portion to a rear side of the connecting portion so that a length-directional axis of the handle body is parallel to a top surface of the second housing.

3. The cleaner of claim 2, wherein the length-directional axis of the handle body is located in a plane vertical to the ground surface by passing through a length directional center of the inlet pipe.

4. The cleaner of claim 1, wherein the battery receiving portion is disposed to a left or right side within the second housing, and wherein the fan is disposed to another side among the left or right side within the second housing.

5. The cleaner of claim 1, further comprising a second housing cover provided on one lateral side of the second housing, the second housing having a multitude of air discharge holes.

6. The cleaner of claim 1, further comprising a housing communicating hole formed in a circumferential surface of the first housing to enable the first housing and the second housing to communicate with each other.

7. The cleaner of claim 6, the fan comprising:

a motor including a stator, a rotor rotated by the stator, and an impeller rotation shaft provided vertical to the ground surface by having the rotor joined thereto;

an impeller connected to the impeller rotation shaft to make air flow; and a fan housing fixed to the second housing and receiving the impeller and the motor therein, wherein a fan housing air inflow port for enabling air to flow into the fan housing is formed in a top surface of the fan housing, and wherein the housing communicating hole is located at a position higher than that of the fan housing air inflow port.

8. The cleaner of claim 1, wherein one portion of a bottom surface of the handle base is coupled to a top surface of the first housing and wherein another portion of the handle base is coupled to a top surface of the second housing.

9. The cleaner of claim 1, wherein a battery insertion port communicating with the battery receiving portion is formed in a rear side surface of the second housing.

10. The cleaner of claim 9, wherein the battery receiving portion has a height-directional length greater than a right-left width-directional length.

11. The cleaner of claim 1, wherein the battery receiving portion has a height-directional length greater than a front-rear-directional length.

* * * * *